United States Patent [19]

Adler

[11] 4,392,754

[45] Jul. 12, 1983

[54] MAGNETIC DOT MATRIX PRINTING METHOD AND APPARATUS

[75] Inventor: Robert Adler, Northfield, Ill.

[73] Assignee: Extel Corporation, Northbrook, Ill.

[21] Appl. No.: 347,716

[22] Filed: Feb. 10, 1982

[51] Int. Cl.[3] ..... B41J 3/12; B41J 27/16; B41J 3/16

[52] U.S. Cl. ..... 400/119; 101/DIG. 5; 101/426; 346/74.2

[58] Field of Search ..... 400/118, 119; 101/DIG. 5, 93.04, 426; 346/74.2, 74.5; 430/39

[56] References Cited

U.S. PATENT DOCUMENTS

| | | | |
|---|---|---|---|
| 2,841,461 | 7/1958 | Gleason | 346/74.5 X |
| 2,985,135 | 5/1961 | Hickerson | 400/119 |
| 3,142,840 | 7/1964 | Smith et al. | 346/74.5 |
| 3,254,626 | 6/1966 | Uemura | 346/74.5 X |
| 3,593,832 | 7/1971 | Damouth et al. | 400/119 |
| 3,683,382 | 8/1972 | Ballinger | 101/DIG. 5 |
| 3,684,075 | 8/1972 | Staller et al. | 400/119 |
| 3,735,416 | 5/1973 | Ott et al. | 346/74.2 |
| 3,825,936 | 7/1974 | Ott et al. | 346/74.2 |
| 3,890,623 | 6/1975 | Schmid et al. | 346/74.5 |
| 4,072,957 | 2/1978 | Kokaji et al. | 346/74.2 |

FOREIGN PATENT DOCUMENTS

| | | | |
|---|---|---|---|
| 23452 | 2/1981 | European Pat. Off. | 101/DIG. 5 |

*Primary Examiner*—Paul T. Sewell

*Attorney, Agent, or Firm*—Kinzer, Plyer, Dorn & McEachran

[57] ABSTRACT

A method and apparatus for character-by-character magnetic printing on plain paper, using a dot matrix format; a sheet of paper is positioned on the surface of a thin, elongated strip platen of permanent magnet material and a magnetic printhead comprising a columnar array of electromagnets scans the platen. Selective energization of the electromagnets, during each scan, magnetizes dot-size portions of the platen in dot matrix patterns defining magnetic images of the characters in a line of text; limited quantities of toner are applied to the paper generally concurrently with formation of the magnetic images to develop those images as visible characters, which are subsequently fixed on the paper surface.

48 Claims, 12 Drawing Figures

Fig. 3.
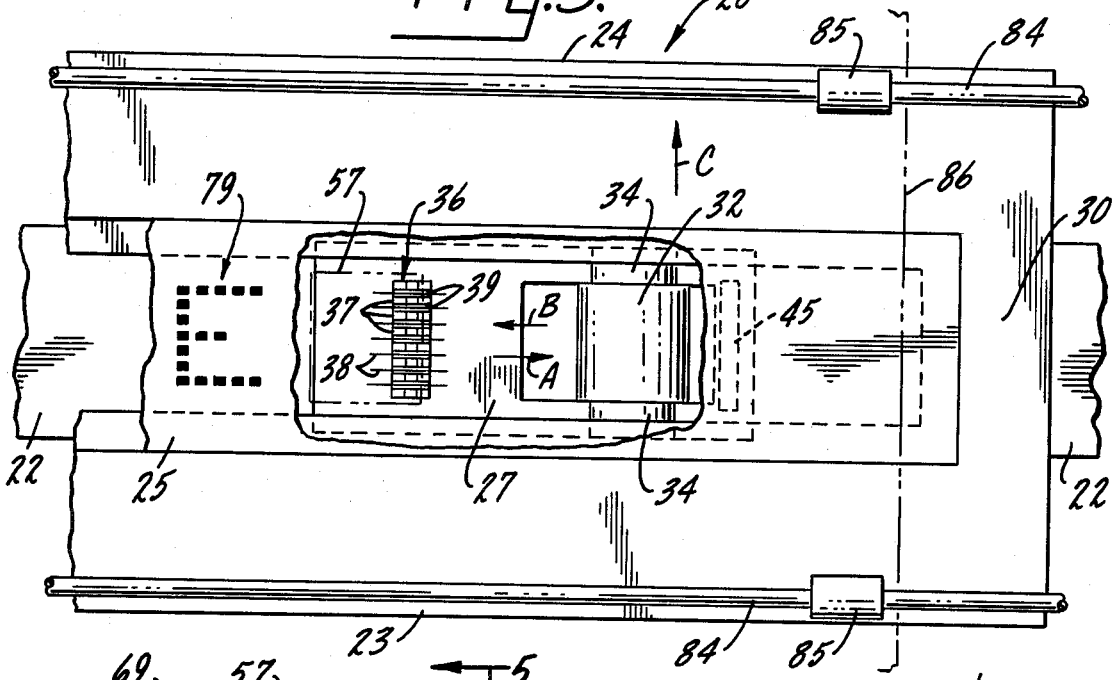
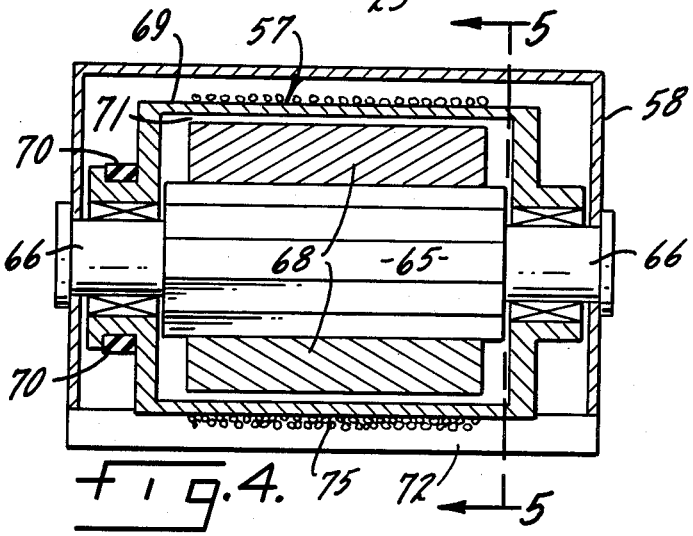
Fig. 4.
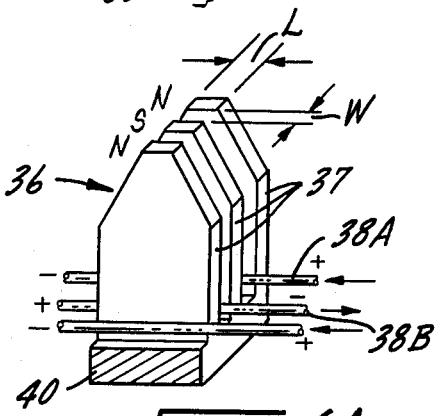
Fig. 6A.
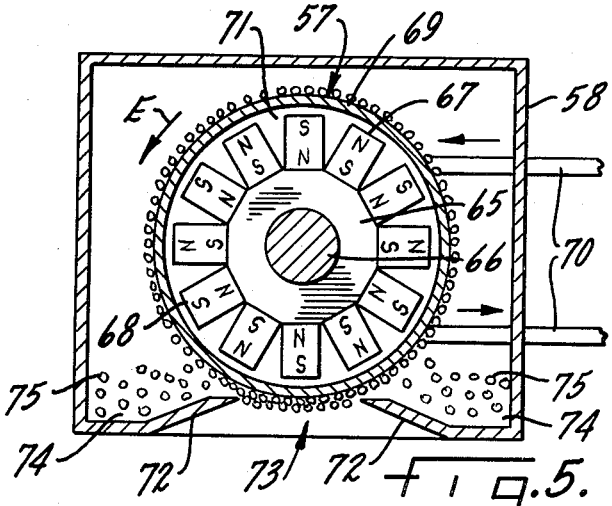
Fig. 5.
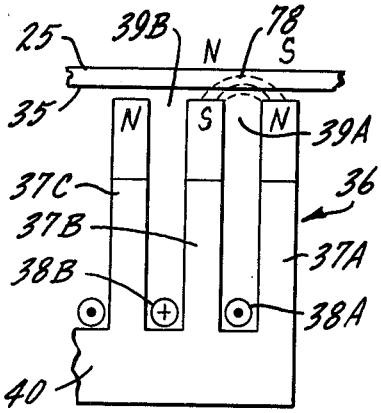
Fig. 6B.

MAGNETIC DOT MATRIX PRINTING METHOD AND APPARATUS

CROSS REFERENCE TO RELATED APPLICATION

A modification of this invention is described and claimed in the co-pending application of Patricio E. Donoso, entitled "Magnetic Dot Matrix Printing", Ser. No. 347,649, filed concurrently herewith.

BACKGROUND OF THE INVENTION

In many printer applications, including virtually all general office applications, character-by-character reproduction on plain paper is a basic requirement; availability of the last character printed for operator inspection (last character visibility or "LCV") is always highly desirable and sometimes essential. These applications include communication printers (telex and the like), word processors, and even ordinary typewriters.

Despite an undesirably high noise level, impact printers of various kinds, including column-sequential dot matrix printers, printers having individual character keys such as conventional typewriters, and unitary font impact printers, such as "golf ball" and "daisy wheel" printers, predominate. The dominance of the impact printers results from their general capability of reproduction on plain paper on the requisite character-by-character basis, ready adaptability to provision of last character visibility, and basic economy and reliability in construction and operation.

The noise problem inherent in impact printers of all kinds is effectively eliminated in electrostatic printers and in electromagnetic printers, which have been successful in some high high speed and high volume printing applications. These devices, however, have not proved competitive in general office applications requiring machines of minimal complexity and subject to only moderate requirements as regards speed or volume of output. On the one hand, electrostatic and electromagnetic printing techniques are difficult to adapt to character-by-character data reproduction, and are even more difficult to apply to a printer affording LCV capability. On the other hand, when adapted to individual character reproduction the cost and complexity of reliable electrostatic or electromagnetic printing mechanisms capable of printing on plain paper tend to be excessive as compared with impact printers.

SUMMARY OF THE INVENTION

It is a principal object of the present invention, therefore, to provide a new and improved method and apparatus for electromagnetic printing on plain paper, character-by-character, suitable for general office applications.

Another object of the invention is to provide a new and improved method and apparatus for electromagnetic printing on a character-by-character basis on plain paper that allows for effective last character visibility.

A further object of the invention is to provide a new and improved electromagnetic printer, affording character-by-character printing on plain paper, that is simple and economical in construction and reliable and quiet in operation.

Accordingly, in one aspect the present invention is directed to a method of magnetic dot matrix printing, for printing a character text, character-by-character, on a sheet of non-magnetic paper, comprising the following steps in sequence:

A. positioning a sheet of non-magnetic paper on a platen of erasable permanent magnet material with the platen aligned with a portion of the paper comprising a location for a line of text;

B. moving a magnetic recording head, comprising a plurality of electromagnets having magnetizing poles corresponding to a group of character matrix dots, along a print path traversing the text line location, in closely spaced relation to one platen surface;

C. magnetizing dot-size portions of the platen in accordance with predetermined patterns constituting magnetic images of the characters for a line of text by selectively energizing the electromagnets for limited intervals during step B;

D. developing visible images of the data characters on the paper by applying limited quantities of a magnetic toner to the exposed surface of the paper overlying the platen generally concurrently with formation of the magnetic images in step C; and E. fixing the visible toner images on the paper.

In another aspect, the invention is directed to a magnetic dot matrix printer for printing a character text, character-by-character, on a sheet of non-magnetic paper, comprising an elongated strip platen of erasable permanent magnet material, means for positioning a sheet of non-magnetic paper on one surface of the platen with the platen extending across the paper in alignment with a portion of the paper comprising a location for a line of text, and carriage means reciprocally movable along a print path adjacent the platen, from one end of the text-line location to the other and back again. Magnetic recording head means, mounted on the carriage means and comprising a plurality of electromagnets having magnetizing poles corresponding to a group of character matrix dots disposed in closely spaced proximity to one platen surface, are provided for magnetizing dot-size portions of the platen in accordance with predetermined patterns constituting magnetic images of the characters for a line of text by selective energization of the electromagnets during movement of the carriage. Magnetic toner dispensing means, mounted on the carriage means, apply limited quantities of a magnetic toner to the exposed surface of the paper overlying the platen generally concurrently with formation of the aforesaid magnetic images to develop visible images on the paper. Fixing means are provided for fixing the visible toner images on the paper to complete printing of a line of text. Magnetic erasing means, mounted on the carriage means, are employed to erase the magnetic images from the platen in preparation for printing a further line of text.

BRIEF DESCRIPTION OF THE DRAWINGS

FIG. 3 is a sectional plan view taken approximately as indicated by line 3—3 in FIG. 1;

FIG. 4 is a detail sectional view, on an enlarged scale, of a toner dispensing device incorporated in the printer mechanism of FIG. 1 taken approximately as indicated by line 4—4 in FIG. 1;

FIG. 5 is a detail sectional view taken approximately as indicated by line 5—5 in FIG. 4;

FIGS. 6A and 6B are enlarged detail views used to explain operation of the recording head in the printer of FIGS. 1-5;

DESCRIPTION OF THE PREFERRED EMBODIMENTS

Figure 1:
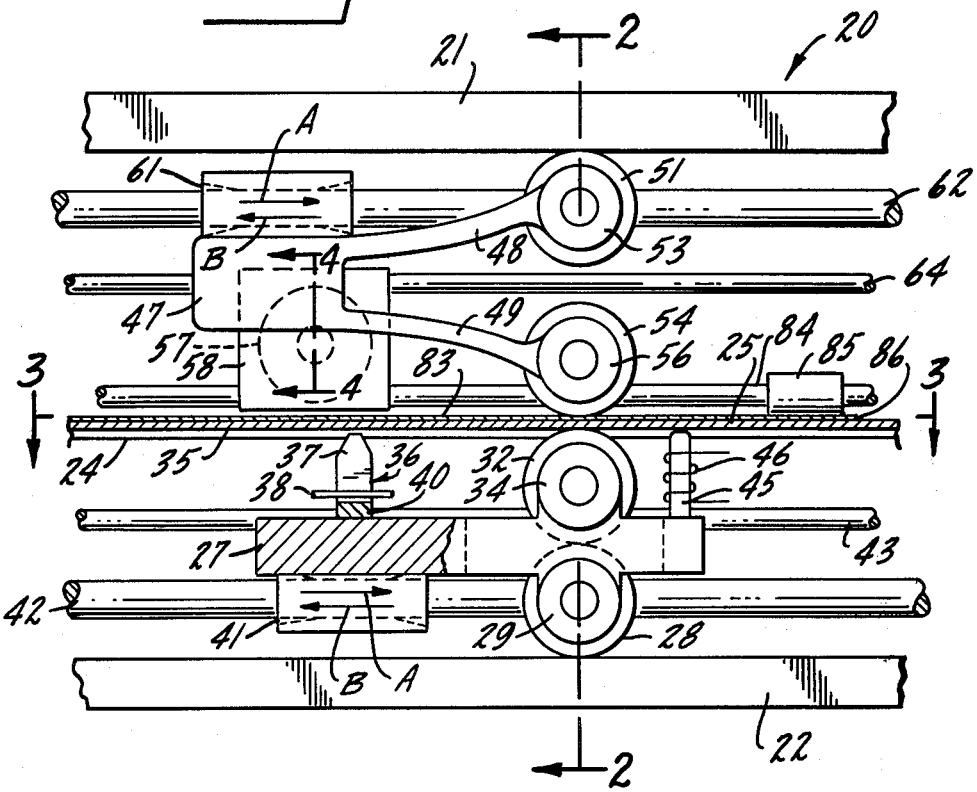
FIG. 1 is a partially sectional elevation view of a magnetic dot matrix printer constructed in accordance with one embodiment of the present invention and capable of performing the printing method of the invention.
Figure 2:
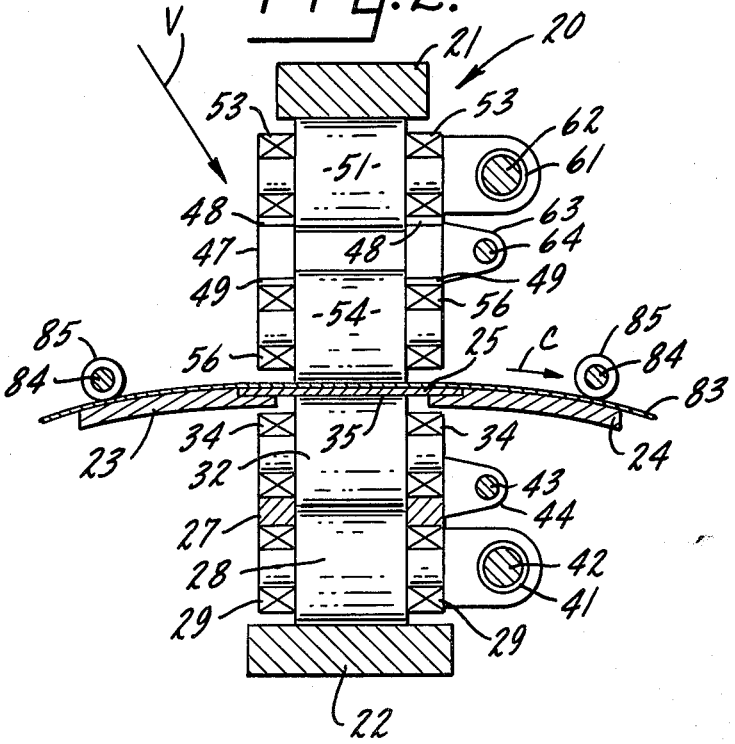
FIG. 2 is a sectional elevation view taken approximately as indicated by line 2—2 in FIG. 1.

FIGS. 1-3 illustrate a magnetic dot matrix printer 20 constructed in accordance with one embodiment of the present invention and capable of carrying out a method of dot matrix printing pursuant to the invention. In FIG. 1-3, only those portions of the printer specifically directed to the present invention are illustrated; familiarity with conventional printer apparatus, including line feed paper drive mechanisms and operating circuits, printhead carriage drive mechanisms and circuits, dot matrix print element energizing circuits, and like conventional components is assumed.

FIGS. 1-3 illustrate the printing station of printer 20, comprising an upper fixed frame member 21 and a lower fixed frame member 22; the two frame members extend across the printing station of printer 20 in spaced relation to each other. A pair of fixed platen supports 23 and 24 also extend across printer 20, at a location intermediate frame members 21 and 22. As shown in FIG. 3, the platen supports 23 and 24 may be formed as integral parts of a single support member, being joined by an end platen support 30.

A thin, elongated strip platen 25 is mounted upon the platen supports 23 and 24, extending transversely of printing apparatus 20 at a location intermediate frame members 21 and 22. In this embodiment of the invention the platen is formed of an erasable permanent magnet material having high remanence and moderate coercive force. Two specific permanent magnet materials that can be used for the platen in printer 20 are a copper-nickel-iron alloy known by the trade name "Cunife" and a chromium-nickel-iron alloy designated as "Chromindur". For these materials, the magnetic characteristics are approximately as follows:

| Cunife: | Chromindur |
|---|---|
| $H_c$ = 550 oersteds | $H_c$ = 500 oersteds |
| $B_r$ = 5,400 gauss | $B_r$ = 10,000 gauss |

The thickness of platen 25 is preferably of the order of approximately 0.1 to 0.25 millimeters, for reasons that will be made apparent in connection with the operational description set forth below.

Printer 20 further comprises a lower carriage 27 and an upper carriage 47 (see FIG. 1) sometimes referred to conjointly as the "carriage means". The first carriage 27 is supported upon a roller 28 that is rotatably mounted upon carriage 27 by suitable means such as the bearings 29. Roller 28 rides upon the upper surface of frame member 22. A pressure fixing roller 32 is also mounted upon carriage 27 by suitable means such as the bearings 34. Fixing roller 32 is positioned immediately above and in contact with roller 28 and also engages the bottom surfaces 35 of platen 25, as best seen in FIGS. 1 and 2. Anti-friction bearings (e.g. ball bearings or roller bearings) are preferred for both sets of bearings 29 and 34, but sleeve bearings can be employed.

A magnetic recording head 36 is mounted on the first carriage 27. The magnetic recording head comprises a plurality of electromagnets formed by a series of vertical magnetic cores 37 projecting upwardly from a common magnetic base 40 and a series of electrical conductors 38 extending through the core structure between the individual cores (FIGS. 1 and 3). Each electromagnet includes two of the cores 37 and the intervening conductor 38, thus affording two magnetizing poles separated by a small air gap. The interior cores 37 each constitute part of two of the electromagnets, as explained hereinafter in connection with FIGS. 6A and 6B.

As best shown in FIG. 3, the pole gaps 39 between the electromagnet cores 37 are arranged in a columnar array; the illustrated arrangement includes eight cores 37 and seven conductors 38 so that there are seven electromagnets in recording head 36, suitable for printing in the familiar seven-by-five dot matrix pattern frequently employed in various type of dot matrix printers. However, it should be understood that the number of electromagnets in recording head 36 is a matter of design choice; a larger or smaller number of electromagnets may be utilized. Furthermore, the electromagnets of the recording head may be arranged in two staggered columns or in other appropriate patterns, so long as the arrangement selected is suitable for printing alphabetic, numeric, and other data characters.

A slide bearing 41 is mounted on carriage 27, as shown in FIGS. 1 and 2. Slide bearing 41 engages a fixed lower guide rail 42 that extends across printer 20 parallel to platen 25. A drive cable 43 affixed to a bracket 44 on carriage 27 provides a means for driving the carriage longitudinally back and forth along the platen as indicated by the arrows A and B.

An erasing electromagnet comprising a core 45 and a coil 46 is also mounted on carriage 27. As best shown in FIG. 3, the core 45 of the erasing electromagnet extends across the major portion of platen 25, at least for the full length of the array of electromagnets.

The second (upper) carriage 47 of printer 20 includes two spring arms 48 and 49 (FIGS. 1 and 2). A roller 51 is mounted between the outer ends of the upper spring arms 48 by means of suitable anti-friction bearings 53. Roller 51 engages the bottom surface of the upper fixed frame member 21. Similarly, a pressure fixing roller 54 is rotatably mounted between the outer ends of the spring arms 49 by means of a pair of anti-friction bearings 56. The two rollers 51 and 54 on carriage 47 are aligned with each other but are not in contact. More importantly, the upper fixing roller 54 is positioned immediately above the lower fixing roller 32.

A dispenser for magnetic toner is incorporated in printer 20, being illustrated as a magnetic brush 57 (FIG. 1). The magnetic brush 57 is mounted in a housing 58 which is in turn mounted upon carriage 47. The construction of magnetic brush 57 is explained more fully in connection with FIGS. 4 and 5.

For guidance of the movements of carriage 47, which travels back and forth along platen 45 as indicated by arrows A and B, a slide bearing 61 is mounted upon the carriage. Slide bearing 61 engages an elongated fixed guide rail 62 extending across printer 20 below the upper frame member 21. A drive cable 64 is secured to carriage 47 by means of a bracket 63; see FIGS. 1 and 2.

The construction and operation of the toner dispenser comprising magnetic brush 57 can best be understood with reference to FIGS. 4 and 5. As shown therein, magnetic brush 57 comprises a stationary central shaft 65 having end portions 66 of reduced diameter mounted in housing 58. A plurality of radially magnetized segmental permanent magnets 67 and 68 are affixed to shaft 65 in alternation with each other. The permanent magnets 67 are magnetized to have north outer poles and the magnets 68 are magnetized with their south poles outermost. A unitary, radially magnetized annular permanent magnet can be substituted for this segmental magnet structure if desired.

A cylindrical non-magnetic shell 69 is rotatably mounted within housing 58 in encompassing relation to the annular array of magnets 67 and 68. Shell 69 is continuously rotated by suitable means, such as a drive belt 70 and a small electrical motor (not shown). A small annular air gap 71 separates shell 69 from the outer pole faces of the permanent magnets 67 and 68.

The bottom wall of housing 58 (FIGS. 4 and 5) comprises two upwardly inclined segments 72 separated by a relatively wide opening 73. Thus, an appreciable portion of the bottom of the shell 69 is exposed through opening 73. The bottom wall segments 72 also form two shallow pockets 74 for storing a limited quantity of magnetic toner particles 75.

Magnetic brush 57, as illustrated in FIGS. 4 and 5, is generally conventional; a magnetic brush of this general type is described in Berkowitz U.S. Pat. No. 3,945,343. Accordingly, only a brief description of its basic mode of operation is necessary. In use, shell 69 is rotated continuously, revolving around the ring of permanent magnets 67 and 68 in the direction indicated by arrow E, FIG. 5. The toner particles 75 are magnetically attracted toward the surface of shell 69 by magnets 67,68 and migrate around the periphery of the shell in the direction of rotation, arrow E. This brings the toner particles 75 on the surface of shell 69 to the opening 73 in the bottom wall 72 of housing 58. These toner particles are thus available for attraction, in a downward direction from magnetic brush 57, in response to any magnetic pole at a location below the brush.

Printer 20 (FIGS. 1–3) includes suitable means for positioning a sheet 83 of non-magnetic paper on platen 25 in surface-to-surface contact with the platen. Because paper feed mechanisms are well known in the art, only a minimum portion of this part of the printer is shown in the drawings, comprising a pair of paper bails 84 with rollers 85 that engage the paper sheet near its edges 86. However, it should be understood that the complete printer includes an appropriate paper feed mechanism for advancing the paper sheet 83 across platen 25 in line-width increments in the direction indicated by arrow C in FIGS. 2 and 3.

In utilizing printer 20 to carry out the method of the present invention, a sheet of ordinary paper 83 is positioned in surface-to-surface contact with the erasable permanent magnet platen 25 as shown in FIGS. 1 and 2; the location of the right-hand edge of the paper sheet is indicated by line 86 in FIG. 3. The paper sheet is held in firm engagement with the platen by the rollers 85 on bails 84. The platen extends across the paper in alignment with a portion of the paper comprising a location for printing a line of text on the paper.

To print a line of text on paper 83, the two carriages 27 and 47 are first driven conjointly along a print path extending longitudinally of platen 25 from the left-hand side to the right-hand side of the paper, as viewed in FIGS. 1 and 3, in the direction of arrow A. This causes the magnetic recording head 36 to scan the lower surface 35 of platen 25, traversing the desired text line location. During this scanning movement, in the direction of arrow A, the electrical conductors 38 of the electromagnets comprising recording head 36 are selectively energized for brief intervals to magnetize dot size portions of the platen 25.

This magnetization operation can best be understood with reference to FIGS. 6A and 6B. When one of the conductors 38A is supplied with an electrical energizing current of the indicated polarity, magnetic flux is generated across the gap 39A between the two adjacent cores or pole pieces 37A and 37B, with the indicated magnetic polarity. A portion of the magnetic field across the two poles 37A and 37B extends upwardly through the thin permanent magnet platen 25 as indicated by flux lines 78 in FIG. 6B. Conductor 38A is energized for only a very brief interval, and with an amplitude sufficient to provide a magnetic field that is effective to magnetize a dot-size area of length L and width W in the upper surface of the platen. Dimensions L and W are determined primarily by the dimensions of the tips of cores 37. When conductor 38A is de-energized, the magnetized dot area at the upper surface of platen 25 has the polarity marked in FIG. 6B above the platen. An energizing current through conductor 38B has the same effect, using cores 37B and 37C and gap 39B, except that the polarity is reversed. Thus, core 37B is a part of two electromagnets, one including conductor 38A and core 37A, the other including conductor 38B and core 37C. Core 37B is always a south pole, in either electromagnet; cores 37A and 37C are always north poles.

As previously noted, for successful operation of the embodiment of FIGS. 1–6, platen 25 should constitute an erasable permanent magnet material of high remanence and adequate coercive force. The Cunife and Chromindur alloys previously referred to are effective for this purpose, though other materials having similar characteristics may be employed. It is essential that platen 25 be quite thin in order that the magnetic field can penetrate the platen sufficiently to produce an effective magnet image on the upper platen surface adjacent paper 83 and to preclude undue spreading of the magnetic dot images.

By selective energization of the electromagents of recording head 36, during movement of carriage 27 along platen 25 in the direction of arrow A, multiple dot-size magnets are generated in the platen, constituting magnetic images of the data characters for a line of text. One such character 79 is shown in FIG. 3. Character 79 is shown in the seven-by-five matrix commonly employed in many impact printers; however, there can be a larger number of dots in each column, and a larger number of columns, particularly if improved print quality is desired.

Magnetic brush 57 moves into position over the magnetic images on platen 25 just after those magnetic images are formed; see FIGS. 1 and 3. The permanent magnet images attract toner particles from the magnetic brush, so that a visible image on each character is developed on the upper surface of paper 83 generally concurrently with formation of the magnetic image of the character. The particular magnetic toner utilized for image development on the paper sheet is not critical. In this instance, it is assumed that the toner is one that can be fixed to the paper by application of adequate pressure. Toners of this pressure-fixing type are available commercially.

From the foregoing description, it will be apparent that a complete line of text, in the form of developed, visible characters, is formed in the course of conjoint movement of the two carriages 27 and 47 along platen 25 from left to right in the direction of arrow A. However, at this juncture, the toner is not affixed to the paper; if the paper were moved, the visible images could all be smeared beyond recognition. To fix the images to the paper, carriages 27 and 47 are moved back along platen 25 in a carriage return movement. During this movement, the two pressure fixing rollers 32 and 54 press the toner particles into paper 83 and effectively fuse the dot characters of the line of text into the paper. This is the reason for use of spring arms 48 and 49 in carriage 47; these arms should be relatively stiff springs to assure adequate fixing pressure. Following the carriage return movement, the paper sheet 83 is advanced a line space increment in the direction of arrow C (FIG. 2) and the printing process is repeated for the next line of text.

Of course, it is necessary to erase the magnetic images from platen 25; this is done during the carriage return movement, in the direction of arrow B. Erasure of the platen in preparation for a new line of text is effected by the erasing electromagnet comprising coil 46 and core 45. In the illustrated construction, coil 46 is energized with an alternating current during the carriage return movement to carry out the requisite erasure.

From the foregoing description of printer 20, representing a first embodiment of the method and apparatus of the invention, it is seen that printing is effectively carried out on a character-by-character basis as required for typewriters, teleprinters, word processors, and other general office printers having low to moderate volume and speed requirements. The noise level is greatly reduced, as compared with any impact printer. Mechanical movements are minimized, being limited essentially to the conjoint movement of carriages 27 and 47 back and forth along platen 25 and the rotation of shell 69 in magnetic brush 57. As a consequence, a high level of reliability and an increased operating life, as compared with impact printers, can be anticipated. On the other hand, ordinary paper is used in the recording medium, so that no cost increase is incurred in this area.

As printer 20 forms each data character, the continuing movement of the second carriage 47 rapidly reveals the last character formed; viewing is easily effected as indicated by arrow V in FIG. 2. If the carriages stop in the middle of platen 25, immediately after completion of a character, that character may be blocked from view by the rear portion of carriage 47 and magnetic brush housing 58. It is a simple matter, however, to provide effective LCV operation even in this circumstance by continuing the advance of the carriages 47 and 27 a short, measured distance in the direction of arrow A when printing is interrupted, clearing the way for viewing of the last character. The carriages can then be returned through the same distance, in the direction of arrow B, if continued printing of additional text on the same line is required.

Figure 7:
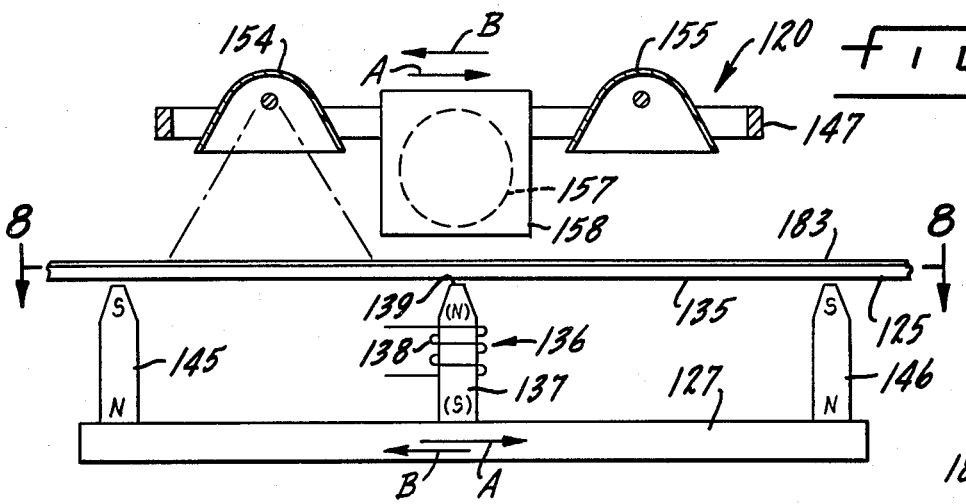
FIG. 7 is a partially schematic elevation view of another embodiment of a magnetic dot matrix printer constructed in accordance with the present invention and effective for carrying out the method of the invention.
Figure 8:
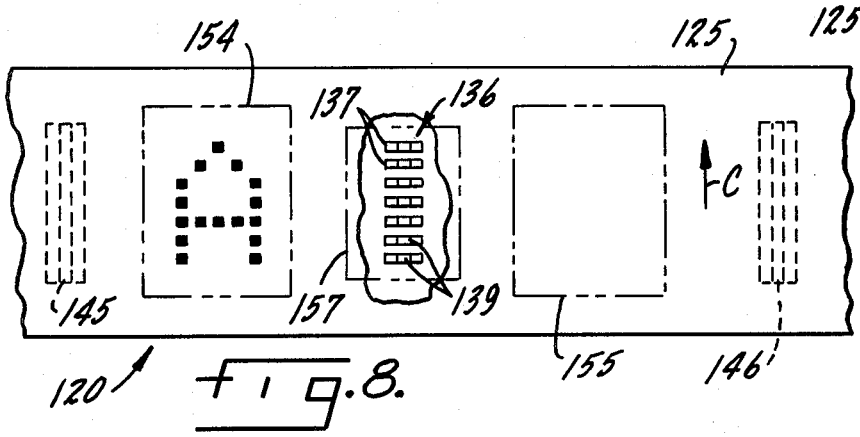
FIG. 8 is a simplified sectional plan view taken approximately as indicated by line 8—8 in FIG. 7.

FIGS. 7 and 8 provide views generally comparable to FIGS. 1 and 3, but illustrate a printer 120 comprising another embodiment of the present invention and capable of carrying out a modification of the method of the invention. Printer 120, as shown in these figures, includes a thin, elongated strip platen 125 upon which a sheet of ordinary non-magnetic paper 183 is positioned. As before, the printer includes carriage means comprising a lower carriage 127 and an upper carriage 147. The first carriage 127 is movable along the length of the platen in the directions indicated by the arrows A and B. A recording head 136 is mounted on carriage 127. This recording head 136 comprises a plurality of electromagnets each including a core 137 having a coil 138 mounted on the core. Cores 137 are of generally bar-like linear configuration, each having a single small pole face 139 facing upwardly toward the bottom surface 135 of platen 125. Carriage 127 also supports two erase magnets 145 and 146; erase magnets 145 and 146 are shown as permanent magnets.

The second carriage 147 moves conjointly with the first carriage 127, as indicated by arrows A and B. A magnetic brush 157 within a housing 158 is mounted on carriage 147. In this instance, the magnetic brush is aligned approximately directly over recording head 136. Two small heating devices 154 and 155 are also mounted on carriage 147, one on each side of magnetic brush 157. Heaters 154 and 155 are preferably relatively intense sources of infra-red radiation, producing sufficient heat for fusion of a heat-fixable magnetic toner. This is the type of toner that is employed in printer 120.

Figure 9:
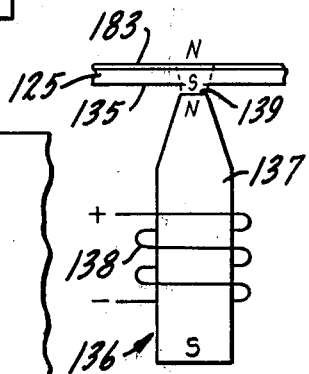
FIG. 9 is a detail view, on an enlarged scale, used to explain operation of the recording head in the printer of FIGS. 7 and 8.

FIG. 9 illustrates the manner in which one of the electromagnets 137,138 magnetizes an incremental area of platen 125. Thus, whenever coil 138 is supplied with an electrical energizing current of the indicated polarity, core 137 develops a north magnetic pole at its pole face 139 immediately adjacent the bottom surface 135 of platen 125. In this instance, the platen is formed of a ferrite material having a high coercive force and low permeability. Energization of the recording electromagnet 137,138 produces a permanently magnetized dot size area in the platen. The dimensions of the dot are determined by the dimensions of pole face 139 and by the intensity of magnetization. The size of the magnetized dot image, as seen from the top surface of platen 125, may tend to increase over the size of the pole face 139 with increased platen thickness. To minimize this "spreading" tendency, the thickness of platen 125 should be held to a minimum. Typically, platen 125 has a thickness of the order of 0.25 millimeters.

In considering the operation of printer 120, in its performance of a modification of the inventive method, it may be assumed that carriages 127 and 147 start out at the left-hand edge of the paper sheet 183 and move across the paper, longitudinally of platen 125, in the direction of arrow A. During this movement, the individual recording head coils 138 are selectively energized for brief intervals to produce dot pattern magnetic images of the data characters desired for a line of text in platen 125. As these magnetic images are formed, they attract toner particles from magnetic brush 157; development of visible images on the upper surface of the paper sheet 183 occurs essentially simultaneously with production of the magnetic images in platen 125.

During this first movement of carriages 127 and 147, in the direction of arrow A, the radiant heat source 154 is energized. Consequently, shortly after each character image is developed with toner from magnetic brush 157, the developed image is fused to paper 183 by the heat from source 154. Furthermore, the magnetic images are erased by the permanent magnet 145, since that magnet is of opposite polarity as compared to the polarization employed for the recording electromagnets. Thus, when the carriage means comprising carriages 127 and 147 has completed its scanning movement across the paper sheet 183, which movement should be carried a short distance beyond the edge of the paper, a complete line of text has been printed and is already fixed on the paper so that the paper can be moved without disturbing the text.

At this juncture, therefore, the paper sheet 183 can be advanced across platen 125 by a line-feed increment, in the direction indicated by arrow C in FIG. 8, bringing a new portion of the paper into alignment with the platen. A further line of text can now be printed on paper 183 during reverse movement of carriages 127 and 147 back across the paper in the direction of arrow B. The only operational difference for printing this second line of text is that heat source 155 is energized and heat source 154 is not. In this instance, the magnetic images are erased, following heat fusion, by the second erasing permanent magnet 146. It is thus seen that printer 120, FIGS. 7–9, is capable of printing during movement of the carriages 127,147 in either direction across the page, as contrasted with the arrangement of FIGS. 1–6 in which the carriage return movement is reserved for pressure fixing of the developed visible images and erasure of the platen. "Erasure", in printer 120, constitutes uniform magnetization of platen 125 to a polarity opposite the polarity of the dot-size magnet areas produced in platen 125 by electromagnets 136,137.

In addition to the capability of printing during both directions of carriage movement, the perpendicular mode magnetization system of printer 120 (FIGS. 7–9) allows for development of the magnetic images formed by recording head 136 in platen 125 by depositing toner on the upper surface of the paper sheet 183 simultaneously with formation of the magnetic images. Because the developed images are fused or fixed almost immediately thereafter, there is less opportunity for any external forces to disturb the printed data prior to fixing. A further advantage is the elimination of high pressure on the platen and of the mechanism for producing that pressure; the energy requirements for carriage movement in the embodiment of FIGS. 7–9 are materially reduced as compared with a pressure fixation system.

Last character visibility is easily provided in a printer employing the general construction and operation described above in connection with FIGS. 7–9. The operating elements on the second (upper) carriage 147 may obscure the last few characters if printing is interrupted in the middle of a line. However, those characters can be readily revealed by moving the carriages a short additional distance when an interruption in printing occurs, and the carriages can be moved back adjacent to the last character when printing is to be resumed. On the other hand, by continuing movement of the carriages only far enough so that the final characters are fixed, last character visibility can be achieved by advancement of the paper, using the technique described and claimed in Mero et al U.S. Pat. No. 3,844,395 if preferred.

Figure 10:
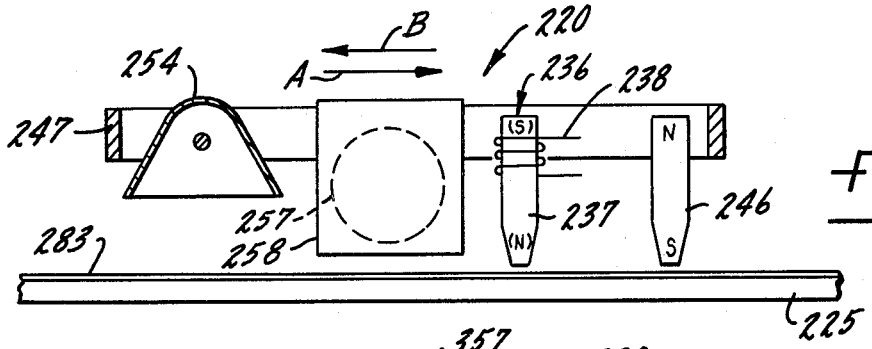
FIG. 10 is a schematic elevation view, similar to FIG. 7, illustrating another embodiment of the invention.

FIG. 10 affords a generally schematic illustration of a printer mechanism 220 that requires only a single carriage 247 positioned above a platen 225 formed of ferrite or other permanent magnet material having a high coercive force and low permeability. In this instance, a recording head 236 comprising a plurality of electromagnets each including a core 237 and a coil 238 is mounted on the carriage 247 above a sheet of paper 283 supported on the platen. An erasing magnet 246, which may be a permanent magnet, is mounted at one end of the carriage in spaced relation to recording head 236. A magnetic brush 257 in a housing 258 is also mounted on carriage 247, spaced as close as possible to recording head 236 and on the opposite side of the recording head from erasing magnet 246. A small infra-red heating device 254 is mounted at the far end of carriage 247 from erasing magnet 246.

In operation of printer 220, printing is carried out with carriage 247 moving from left to right in the direction indicated by arrow A. For this direction of carriage movement, the individual recording head coils 238 are selectively energized for brief intervals to produce dot pattern magnetic images of the data characters desired for a line of text in the ferrite platen 225. Almost immediately after being formed, such images are developed by toner particles attracted to the surface of paper sheet 283 from magnetic brush 257. A short time interval later, the resulting visible toner images on the upper surface of the paper sheet are heat fused by device 254. A carriage return in the direction of arrow B enables erasing magnet 246 to erase the magnetic images from platen 225 in preparation for printing a subsequent line of text.

Printer 220 has the advantage that only a single carriage is required, with the printing components all mounted on the one carriage above platen 225 and paper sheet 283. Thus, there is no need to maintain two carriages with precisely coordinated movements as in the previously described embodiments. Furthermore, platen 225 can be relatively thick; since magnetic recording is effected from the paper bearing side of the platen it does not matter if each dot "spreads" toward the opposite platen surface.

However, there are also some disadvantages. Thus, there is some delay before development of the magnetic images occurs, although as a practical matter development still is carried out generally concurrently with formation of the magnetic images. Of perhaps greater importance is the fact that there is more opportunity for some of the toner particles to migrate to the recording poles of the recording head cores 237 or to be picked up by erasing magnet 246, so that keeping the recording head electromagnets and the erasing magnet clean may present an appreciable problem.

Figure 11:
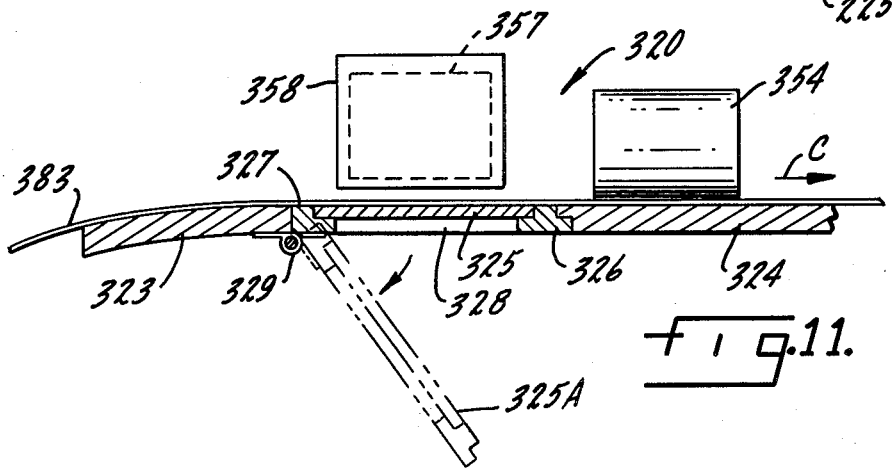
FIG. 11 is a schematic elevation view illustrating an alternative arrangement that may be utilized in fixing developing images in the use of the invention.

FIG. 11 affords a transverse sectional view, generally comparable to FIG. 2, of a modification of the printer 120 of FIGS. 7–9; the printer 320 of FIG. 11 incorporates the invention of the aforementioned Donoso application and eliminates the requirement for fixing while the developed print images are still located above the permanent magnet platen. Thus, in printer 320 a paper recording sheet 383 extends across a thin permanent magnet strip platen 325, the platen again being formed of a ferrite or like material having high coercive force and low permeability as in the case of the platen 125

(FIGS. 7–9). In this instance, platen 325 is mounted in a rectangular frame comprising two side rails 326 and 327 and a pair of end rails 328, only one end rail being shown in the drawing. One side rail 327 of this frame is mounted upon a platen support 323 by means of an elongated piano hinge 329; a series of individual hinges can be used if desired. The other frame member 326 engages a platen support 324 when the platen is in the recording position shown in FIG. 11.

The upper and lower carriages, the electromagnets of the recording head, and the erasing magnet for printer 320 have not been shown in FIG. 11; it may be assumed that they are similar to those shown in FIGS. 7–9. The relative alignment of a magnetic brush 357 and its housing 358 is shown in FIG. 11. In addition, a pressure fixing roller 354 is shown; in this instance, however, the pressure fixing roller is located over platen support 324 instead of being aligned with the platen as in the previously described pressure-fixing system (FIGS. 1 and 2).

Operation of a printer incorporating the modifications indicated by mechanism 320 of FIG. 11, for magnetic recording and development of a line of data characters on paper sheet 383, proceeds in much the same manner as described for the embodiment of FIGS. 7–9. When the line of data text is complete and developed, however, and prior to fixing of the developed toner character images on paper sheet 383, the rectangular frame supporting platen 325 is pivoted, by means of hinge 329, to the phantom line position 325A. This can be accomplished without disturbing the undeveloped printing on paper sheet 383, either by pivotal movement of the platen as indicated or by direct downward movement of the platen, in contrast with a lateral movement of the platen which would smear the print. There is enough adherence between the unfixed toner images and the paper sheet so that the sheet can now be shifted in a line feed direction (arrow C) to bring the printed text into alignment with pressure roller 354. Consequently, while pressure roller 354 rolls across the sheet to fix one line of text, a second line of text can be formed on the surface of the paper 383. With this arrangement, printing can be carried out for movement of the print head carriage along strip platen 325 in either direction if two erasing electromagnets, one for each direction, are provided. A major advantage of the printing mechanism 320 is that pressure fixing is made possible without the danger of undue stress on a thin permanent magnet platen.

It will be recognized that a variety of different combinations of the various features of printers 20, 120, 220 and 320 can be effected; there is little point in attempting to illustrate all such variations. For example, parallel mode magnetic recording, as exemplified by recording head 36, FIG. 1, does not require pressure fixing; heat fusion fixing can be utilized in combination with parallel magnetic recording. Of course, perpendicular mode magnetic recording as effected by recording heads 136 and 236 (FIGS. 7 and 10) can be developed with either pressure-fixed or heat fixed toner. Moreover, bidirectional imaging and developing, as in FIG. 7, can be carried out with pressure fixing of the toner. A given printer need not be restricted solely to unidirectional or bidirectional imaging/developing; thus, printer 120 (FIGS. 7–9) could be controlled for unidirectional printing when used in a typewriter, a telex transceiver, or any other manual data entry application, with a changeover to control for bidirectional printing when used as a receiver.

For all embodiments, printing is a quiet operation as compared to any impact printer. Printing speeds are adequate for all low to moderate volume applications, covering the full range of general office printer requirements. LCV capability is readily realized for all embodiments. And cost and reliability characteristics should be excellent, particularly in view of the minimal number of moving parts.

I claim:

1. A method of magnetic dot matrix printing, for printing a character text, character-by-character, on a sheet of non-magnetic paper, comprising the following steps in sequence:

A. positioning a sheet of non-magnetic paper on a platen of erasable permanent magnet material with the platen aligned with a portion of the paper comprising a location for a line of text;

B. moving a magnetic recording head, comprising a plurality of electromagnets having magnetizing poles corresponding to a group of character matrix dots, along a print path transversing the text line location, in closely spaced relation to one platen surface;

C. magnetizing dot-size portions of the platen in accordance with predetermined patterns constituting magnetic images of the characters for a line of text by selectively energizing the electromagnets for limited intervals during step B;

D. developing visible images of the data characters on the paper by applying limited quantities of a magnetic toner to the exposed surface of the paper overlying the platen generally concurrently with formation of the magnetic images in step C; and E. fixing the visible toner images on the paper.

2. The method of character-by-character magnetic dot matrix printing, according to claim 1, comprising the following additional steps:

F. erasing the magnetic images from the platen;

G. advancing the paper across the platen to bring a new portion of the paper into alignment with the platen; and H. repeating steps A through E to print a subsequent line of text.

3. The method of character-by-character magnetic dot matrix printing, according to claim 1 or claim 2, in which step D is carried out by moving a toner dispenser along the path of the recording head in synchronism with the recording head and in an alignment relative to the recording head such that development of the visible images occurs generally concurrently with formation of the magnetic images in step C.

4. The method of character-by-character magnetic dot matrix printing, according to claim 3, in which the toner dispenser is moved along the path a short distance behind the recording head so that development of the visible images occurs immediately after the formation of the magnetic images in step C.

5. The method of character-by-character magnetic dot matrix printing, according to claim 3, in which the toner dispenser and recording head are located on opposite sides of the platen and the toner dispenser is aligned directly opposite the recording head so that development of the visible images occurs essentially simultaneously with the formation of the magnetic images in step C.

6. The method of character-by-character magnetic dot matrix printing, according to claim 2, in which the recording head magnetizes the platen from the side of the platen opposite the paper.

7. The method of character-by-character magnetic dot matrix printing, according to claim 6, in which the recording head electromagnets magnetize the platen in a parallel mode, with each dot-size magnet formed in the platen comprising spaced north and south poles on the surface of the platen contacted by the paper.

8. The method of character-by-character magnetic dot matrix printing, according to claim 6, in which the recording head electromagnets magnetize the platen in a perpendicular mode, with each dot-size magnet formed in the platen comprising a pole of given polarity on the surface of the platen contacted by the paper and a pole of opposite polarity on the opposite surface of the platen.

9. The method of character-by-character magnetic dot matrix printing, according to claim 8, in which development of the visible images in step D is carried out essentially simultaneously with formation of the magnetic images in step C.

10. The method of character-by-character magnetic dot matrix printing, according to claim 2, in which step E is carried out by moving two opposed pressure rollers across the paper, along the recording head path, pressing the platen and paper together between the rollers and thereby pressure-fixing the visible toner images on the paper.

11. The method of character-by-character magnetic dot matrix printing, according to claim 10, in which the recording head magnetizes the platen from the side of the platen opposite the paper.

12. The method of character-by-character magnetic dot matrix printing, according to claim 11, in which the recording head electromagnets magnetize the platen in a parallel mode, with each dot-size magnet formed in the platen comprising spaced north and south poles on the surface of the platen contacted by the paper.

13. The method of character-by-character magnetic dot matrix printing, according to claim 11, in which the recording head electromagnets magnetize the platen in a perpendicular mode, with each dot-size magnet formed in the platen comprising a pole of given polarity on the surface of the platen contacted by the paper and a pole of opposite polarity on the opposite surface of the platen.

14. The method of character-by-character magnetic dot matrix printing, according to claim 13, in which development of the visible images in step D is carried out essentially simultaneously with formation of the magnetic images in step C.

15. The method of character-by-character magnetic dot matrix printing, according to claim 2, in which step E is carried out by moving a heating device across the paper, along the recording head path, heating the visible toner images to fix them on the paper.

16. The method of character-by-character magnetic dot matrix printing, according to claim 15, in which the recording head magnetizes the platen from the side of the platen opposite the paper.

17. The method of character-by-character magnetic dot matrix printing, according to claim 16, in which the recording head electromagnets magnetize the platen in a parallel mode, with each dot-size magnet formed in the platen comprising spaced north and south poles on the surface of the platen contacted by the paper.

18. The method of character-by-character magnetic dot matrix printing, according to claim 16, in which the recording head electromagnets magnetize the platen in a perpendicular mode, with each dot-size magnet formed in the platen comprising a pole of given polarity on the surface of the platen contacted by the paper and a pole of opposite polarity on the opposite surface of the platen.

19. The method of character-by-character magnetic dot matrix printing, according to claim 18, in which development of the visible images in step D is carried out essentially simultaneously with formation of the magnetic images in step C.

20. The method of character-by-character magnetic dot matrix printing, according to claim 15, in which two heating devices are provided, and in which successive lines of text are printed with the recording head moving in opposite directions along its print path.

21. The method of character-by-character magnetic dot matrix printing, according to claim 2, in which the recording head magnetizes the platen through the paper.

22. The method of character-by-character magnetic dot matrix printing, according to claim 21, in which the recording head electromagnets magnetize the platen in a perpendicular mode, with each dot-size magnet formed in the platen comprising a pole of given polarity on the surface of the platen contacted by the paper and a pole of opposite polarity on the opposite surface of the platen.

23. The method of character-by-character magnetic dot matrix printing, according to claim 22, in which step E is carried out by moving a heating device across the paper, along the recording head path, heating the visible toner images to fix them on the paper.

24. The method of character-by-character magnetic dot matrix printing, according to claim 2, in which step B is always carried out with the recording head moving in a given direction along its print path, and in which the recording head is moved back in the opposite direction along that path during step F.

25. The method of character-by-character magnetic dot matrix printing, according to claim 2, in which successive lines of text are printed with the recording head moving in opposite directions along its print path.

26. A magnetic dot matrix printer for printing a data character text, character-by-character, on a sheet of non-magnetic paper, comprising:

an elongated strip platen of erasable permanent magnet material;

means for positioning a sheet of non-magnetic paper on one surface of the platen with the platen extending across the paper in alignment with a portion of the paper comprising a location for a line of text;

carriage means reciprocally movable along a print path adjacent the platen, from one end of the text-line location to the other and back again;

magnetic recording head means, mounted on the carriage means and comprising a plurality of electromagnets having magnetizing poles corresponding to a group of character matrix dots disposed in closely spaced proximity to one platen surface, for magnetizing dot-size portions of the platen in accordance with predetermined patterns constituting magnetic images of the characters for a line of text by selective energization of the electromagnets during movement of the carriage;

magnetic toner dispensing means, mounted on the carriage means, for applying limited quantities of a magnetic toner to the exposed surface of the paper overlying the platen generally concurrently with formation of the aforesaid magnetic images to develop visible images on the paper;

fixing means for fixing the visible toner images on the paper to complete printing of a line of text; and magnetic erasing means, mounted on the carriage means, for erasing the magnetic images from the platen in preparation for printing a further line of text.

27. A magnetic dot matrix character-by-character printer, according to claim 26, in which the carriage means comprises a first carriage positioned adjacent the side of the platen opposite the paper and a second carriage positioned adjacent the paper bearing side of the platen and movable conjointly with the first carriage, the recording head means and the erasing means being mounted on the first carriage and the toner dispensing means being mounted on the second carriage.

28. A magnetic dot matrix character-by-character printer, according to claim 26 or claim 27, in which the toner dispensing means comprises a rotary magnetic brush, extending transversely of the print path, for dispensing magnetic toner by magnetic attraction to the magnetic images.

29. A magnetic dot matrix character-by-character printer, according to claim 26, or claim 27, in which:

each electromagnet comprises two magnetic cores aligned in closely spaced relation to each other immediately adjacent the side of the platen opposite the paper, and an electrical conductor extending through the space between the cores: and the platen comprises a thin strip of permanent magnet material having high remanence and moderate coercive force;

each electromagnet, when energized, magnetizing a dot size area on the paper bearing surface of the platen in a parallel mode affording spaced north and south poles on that surface of the platen.

30. A magnetic dot matrix character-by-character printer, according to claim 29, in which magnetic recording and visible image development occur during movement of the carriages in a recording direction along the print path, and image fixing and magnetic erasing occur during return movement of the carriages in the opposite direction along the print path, and in which:

the toner dispensing means is spaced by a short distance from the recording head, along the print path, trailing behind the recording head during movement of the carriages in the recording direction.

31. A magnetic dot matrix character-by-character printer, according to claim 29, for use with a pressure fixable magnetic toner, in which the fixing means comprises:

a first fixing roller mounted on the carriage means on one side of the platen; and a second fixing roller mounted on the carriage means on the opposite side of the platen, directly opposite the first fixing roller;

the two fixing rollers pressing the paper and the platen together during movement of the carriage means along the print path to pressure fix the visible images on the paper.

32. A magnetic dot matrix character-by-character printer, according to claim 29, for use with a heat fixable magnetic toner, in which the fixing means comprises heater means for heating the visible toner images.

33. A magnetic dot matrix character-by-character printer, according to claim 32, in which the heater means comprises a radiant heater, mounted on the carriage means, for fixing the visible toner images while still positioned on the platen.

34. A magnetic dot matrix character-by-character printer, according to claim 26 or claim 27, in which:

each electromagnet comprises a magnetic core having a single dot-size magnetizing pole immediately adjacent the side of the platen opposite the paper, and a coil mounted on the core; and the platen comprises a thin strip of permanent magnet material having high coercive force and low permeability;

each electromagnet, when energized, magnetizing a dot size portion of the platen in a perpendicular mode affording a single pole of given polarity facing the paper.

35. A magnetic dot matrix character-by-character printer, according to claim 34, in which the recording head and the toner dispensing means are on opposite sides of the platen and the toner dispensing means is in direct alignment with the recording head so that development of the visible images occurs essentially simultaneously with formation of the magnetic images.

36. A magnetic dot matrix character-by-character printer, according to claim 34, in which the magnetic image dots are all of one polarity at the paper bearing surface of the platen, and the erasing means comprises a permanent magnet that magnetizes the entire platen uniformly so that the paper bearing surface of the platen is of the opposite polarity.

37. A magnetic dot matrix character-by-character printer, according to claim 36, in which the recording head and the toner dispensing means are on opposite sides of the platen and the toner dispensing means is in direct alignment with the recording head so that development of the visible images occurs essentially simultaneously with formation of the magnetic images.

38. A magnetic dot matrix character-by-character printer, according to claim 34, for use with a pressure fixable magnetic toner, in which the fixing means comprises:

a first fixing roller mounted on the carriage means on one side of the platen; and a second fixing roller mounted on the carriage means on the opposite side of the platen, directly opposite the first fixing roller;

the two fixing rollers pressing the paper and the platen together during movement of the carriage means along the print path to pressure fix the visible images on the paper.

39. A magnetic dot matrix character-by-character printer, according to claim 34, for use with a heat fixable magnetic toner, in which the fixing means comprises heater means for heating the visible toner images.

40. A magnetic dot matrix character-by-character printer, according to claim 39, in which the heater means comprises a radiant heater, mounted on the carriage means, for fixing the visible toner images while still positioned on the platen.

41. A magnetic dot matrix character-by-character printer, according to claim 26 or claim 27, for use with a pressure fixable magnetic toner, in which the fixing means comprises:

a first fixing roller mounted on the carriage means on one side of the platen; and a second fixing roller mounted on the carriage means on the opposite side of the platen, directly opposite the first fixing roller;

the two fixing rollers pressing the paper and the platen together during movement of the carriage means along the print path to pressure fix the visible images on the paper.

42. A magnetic dot matrix character-by-character printer, according to claim 26 or claim 27, for use with a heat fixable magnetic toner, in which the fixing means comprises heater means for heating the visible toner images.

43. A magnetic dot matrix character-by-character printer, according to claim 42, in which the heater means comprises a radiant heater, mounted on the carriage means, for fixing the visible toner images while still positioned on the platen.

44. An electromagnetic dot matrix character-by-character printer, according to claim 43, in which the fixing means comprises two radiant heaters mounted on opposite sides of the toner dispensing means, to enable printing during movement of the carriage means in opposite directions along the print path.

45. A magnetic dot matrix character-by-character printer, according to claim 27 in which:

each electromagnet comprises a magnetic core having a single dot-size magnetizing pole immediately adjacent the side of the platen opposite the paper, and a coil mounted on the core;

the platen comprises a thin strip of permanent magnet material having high coercive force and low permeability;

each electromagnet, when energized, magnetizing a dot size portion of the platen in a perpendicular mode affording a single pole of given polarity facing the paper; and the toner dispensing means is in direct alignment with the recording head so that development of the visible images occurs essentially simultaneously with formation of the magnetic images and enabling printing during movement of the carriages in opposite directions along the print path.

46. A magnetic dot matrix character-by-character printer, according to claim 45, for use with a heat fixable magnetic toner, in which the fixing means comprises two radiant heaters mounted on opposite ends of the second carriage in spaced relation to the toner dispensing means.

47. A magnetic dot matrix character-by-character printer, according to claim 26, in which the carriage means comprises a single carriage positioned adjacent the paper bearing side of the platen, and in which the recording head means, the toner dispensing means, and the erasing means are all mounted on that carriage.

48. A magnetic dot matrix character-by-character printer, according to claim 47, in which:

each electromagnet comprises a magnetic core having a single dot-size magnetizing pole immediately adjacent the paper bearing side of the platen, and a coil mounted on the core;

the platen comprises a thin strip of permanent magnet material having high coercive force and low permeability;

each electromagnet, when energized, magnetizing a dot size portion of the platen in a perpendicular mode affording a single pole of given polarity facing the paper; and the fixing means comprises a raadiant heating device mounted on the carriage in spaced relation to the toner dispensing means.

* * * * *